United States Patent [19]

Noguchi et al.

[11] Patent Number: 4,800,954

[45] Date of Patent: Jan. 31, 1989

[54] LAMINATED HEAT EXCHANGER

[75] Inventors: Ichiro Noguchi; Yoshikiyo Nagasaka; Isamu Kurosawa, all of Konan, Japan

[73] Assignee: Diesel Kiki Co., Ltd., Tokyo, Japan

[21] Appl. No.: 130,298

[22] Filed: Dec. 8, 1987

[30] Foreign Application Priority Data

Dec. 18, 1986 [JP] Japan ..... 61-302292
Dec. 23, 1986 [JP] Japan ..... 61-197818[U]

[51] Int. Cl.[4] ..... F28D 1/02
[52] U.S. Cl. ..... 165/153; 165/174
[58] Field of Search ..... 165/152, 153, 148, 174, 165/176, 172, 76; 29/157.3 R, 157.3 D, 157.3 C

[56] References Cited

U.S. PATENT DOCUMENTS 3,757,855 9/1973 Kun et al. ..... 165/152
4,696,342 9/1987 Yamauchi et al. ..... 165/153

FOREIGN PATENT DOCUMENTS 63-14083 1/1988 Japan .

*Primary Examiner*—Samuel Scott
*Assistant Examiner*—Noah Kamen
*Attorney, Agent, or Firm*—Wenderoth, Lind & Ponack

[57] ABSTRACT

A laminated heat exchanger includes a plurality of parallel spaced tube elements with tanks at one end thereof, and fins disposed between adjacent tube elements. Each tube element has a pair of joint portions projecting from the other end thereof toward two adjacent tube elements and held in abutment with the joint portions of the two adjacent tube elements. The joint portion has a corrugated shape composed of alternate parallel grooves and ridges and hence is rigid enough to withstand external forces. The tube element includes a guide member disposed on a front end of the partition wall for directing a heat transferring medium toward the opposite corners of a guide channel. With the guide member, the heat transferring medium is distributed uniformly over the entire region of the guide channel.

8 Claims, 6 Drawing Sheets

LAMINATED HEAT EXCHANGER

BACKGROUND OF THE INVENTION

1. Field of the Invention

The present invention relates to heat exchangers, and more particularly to a laminated heat exchanger having a multiplicity of tube elements built up in layers.

2. Prior Art

A typical example of heat exchanger of this type is disclosed in Japanese Utility Model Publication No. 53-32375. The disclosed heat exchanger, as reillustrated here in FIG. 11 of the accompanying drawings, includes a tube element 1 composed of a pair of stamped plates 3 (only one shown) joined back to back with each there so as to provide a pair of juxtaposed tanks 4*a*, 4*b* at one end of the tube element 1. The tube element 1 has an elongate central partition wall 18 extending upwardly from the tanks 4*a*, 4*b* toward the opposite end of the tube element 1 so as to define a generally U-shaped channel 5 for the passage of a heat transferring medium. A plurality of such tube elements 1 are laminated or built up in layers with non-illustrated fins interposed between adjacent tube elements 1. The tube elements 1 and the fins are joined together by brazing under heated condition as in a hot oven. Preparatory to such mutual joining, each pair of adjacent tube elements are preassembled together in such a manner that side walls of the respective tanks 4*a*, 4*b* and an upper joining flange (not shown but extending in a direction from the front toward the back of the sheet of drawing) of one tube element 1 are held in abutment with the tanks' side walls and the upper joining flange, respectively, of the other tube element 1.

The joining flange seems to be effective to hold the tube elements in a stably preassembled condition in which the tube elements are spaced at equal intervals or inter-element spaces. In general, in a heat exchanger of the type having tanks at only one end thereof, the tube elements are separated from one another at the other end of the heat exchanger because of interventing fins. The tube elements tend to be displaced, if not the joining flanges or the like clamping means.

Experiments uncovered the fact that the joining flanges held in abutment with each other are likely to bend or yield when subjected to forces or pressures applied in a facewise direction of the tube elements owing to some reason; during the brazing of the preassembled tube elements and the fins in a hot oven. With this deformation of the joining flanges, it is no longer possible to maintain the laminated tube elements in a uniformly spaced condition.

Since the channel 5 defined in each tube element 1 has a U-shape, a heat transferring medium reverses its direction of movement as it flows from one tank 4*a* to the other tank 4*b* along the U-shaped channel 5, the effective heat-exchanging area and the heat-exchanging efficiency of the heat exchanger are greater than that of another conventional heat exchanger having tanks disposed at opposite ends of each tube element.

A problem associated with the U-shaped channel 5 is that due to its tendency toward short-cut, the heat transferring medium flows more intensely in an inner region near the partition wall 18 than in an outer region remote from the partition wall 18, thus producing an outermost dead zone indicated by hatching. With this dead zone, the heat-exchanging efficiency of the heat exchanger is lowered to a certain extent.

SUMMARY OF THE INVENTION

It is accordingly an object of the present invention to provide a laminated heat exchanger having a number of tube elements laminated stably at a uniform inter-element pitch or spacing.

Another object of the present invention is to provide a laminated heat exchanger having structural features which enable an improved circulation of a heat transferring medium for increasing the heat-exchanging efficiency of the heat exchanger.

According to a first aspect of the present invention, there is provided a laminated heat exchanger comprising:

a plurality of parallel spaced tube elements, each said tube element being composed of a pair of stamped plates and having two juxtaposed tanks at one end thereof and an internal guide channel extending contiguously from said tanks for the passage therethrough of a heat transferring medium;

a plurality of corrugated fins each disposed between an adjacent pair of said tube elements;

said tube elements and said fins being laminated into alternate layers; and each said stamped plate including a joint portion extending along an end edge thereof remote from said tanks and having alternate parallel ridges and grooves, said joint portion of one tube element being held in abutment with the joint portion of an adjacent tube element.

The joining portions having such alternate ridge and grooves are structurally rigid enough to withstand external force or pressure which may be applied when the tube elements and the fins are brazed in a hot oven.

According to a second aspect of the present invention, there is provided a laminated heat exchanger comprising:

a plurality of parallel spaced tube elements, each said tube element being composed of a pair of stamped plates and having at least two juxtaposed tanks at one end thereof and an elongate partition wall disposed between and extending from said tanks toward the opposite end thereof so as to define a generally U-shaped guide channel for the passage therethrough of a heat transferring medium;

a plurality of corrugated fins each disposed between an adjacent pair of said tube elements;

said tube elements and said fins being laminated into layers; and a guide member disposed at the distal end of said partition wall for directing the heat transferring medium toward opposite corners of said U-shaped guide channel adjacent to said opposite end of said tube element as the heat transferring medium flows through said U-shaped guide channel.

With this construction, the heat transferring medium as it flows through the guide channel is guided or directed by the guide member outwardly toward the opposite corners of the guide channel and turns along the corners. Thus, the heat transferring medium is distributed evenly over the entire region of the guide channel without producing an objectionable dead zone.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
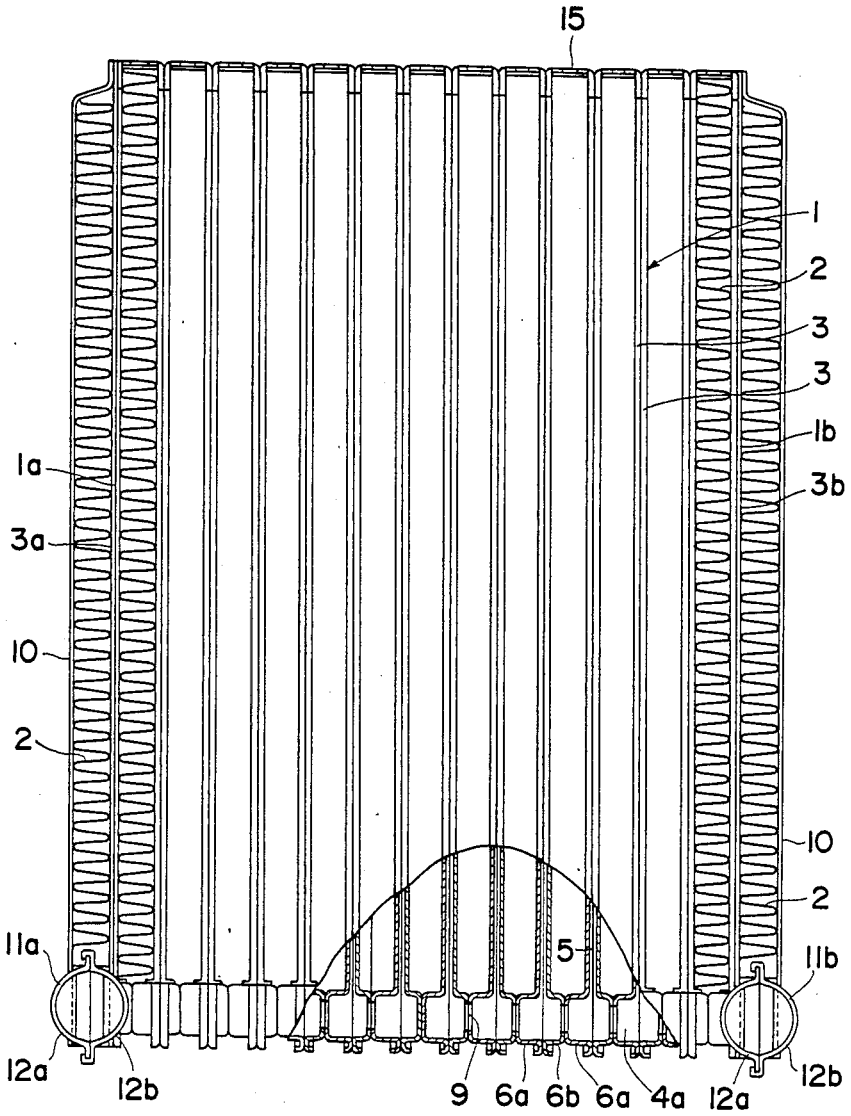
FIG. 1 is a front elevational view, partly in cross section, of a heat exchanger embodying the present invention.

Certain preferred embodiments of the present invention are described below in greater detail with reference to the accompanying drawings. In the drawings, like or corresponding parts are indicated by like or corresponding reference characters throughout the several views.

Figure 2:
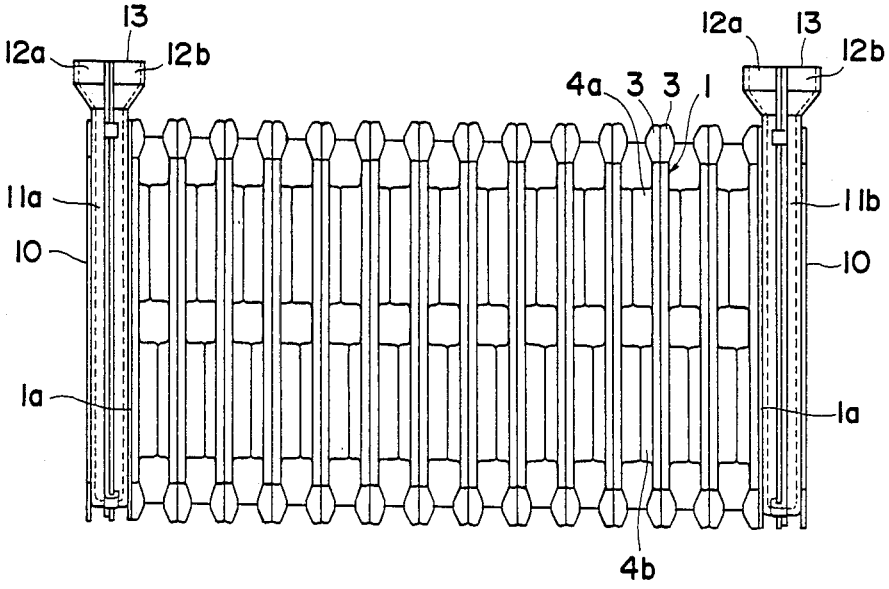
FIG. 2 is a bottom view of FIG. 1.
Figure 6:
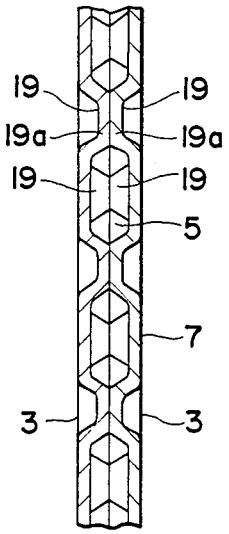
FIG. 6 is an enlarged cross-sectional view of a portion of FIG. 3, showing projections on the stamped plates.

As shown in FIGS. 1 and 2, a laminated heat exchanger embodying the present invention includes alternate rows of parallel spaced tube elements 1 and corrugated fins 2 built up into layers.

Figure 3:
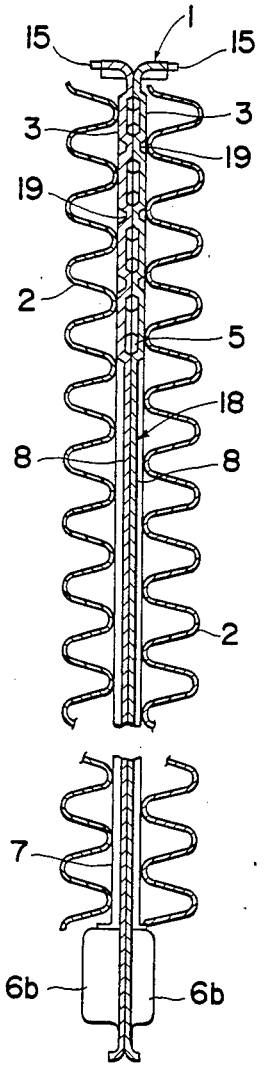
FIG. 3 is an enlarged cross-sectional view of a tube element of the heat exchanger shown in FIG. 1.

Each of the tube elements 1 is composed of a pair of stamped rectangular plates 3 each having two juxtaposed tank-forming bulged portions 6a, 6b at one end thereof and a channel-forming outwardly swelled web portion 7 extending contiguously from the bulged portions 6a, 6b and constituting a major part of the stamped plate 3. The stamped plates 3 are joined together in face-to-face confrontation as shown in FIG. 3 so that the tube element 1 includes two juxtaposed tanks 4a, 4b defined between the opposed bulged portions 6a, 6b and disposed at one end of the tube element 1, and a guide channel 5 defined between the opposed web portions 7, 7 for the passage therethrough of a heat transferring medium. The tank 4a is located at an upstream side while the tank 4b is located at a downstream side. The terms "upstream", "downstream" and derivatives thereof will have reference to the direction of movement of air flowing through the heat exchanger. In FIG. 1, the upstream side is at the front side of this figure when air flows from the front to the back of the sheet of drawing figure.

Two adjacent ones of the tube elements 1 are held in engagement with each other at their tank sides because the bulged portions 6a, 6b of one tube element 1 abut against the bulged portions 6a, 6b of the other tube element 1. The tanks 4a, 4b of the tube elements 1, 1 are held in fluid communication with each other through holes 9 defined in the bulged portions 6a, 6b excepting that the bulged portions 6a, 6a disposed at the upstream side of a central pair of adjacent tube elements 1, 1 have no such holes and hence block movement of the heat transferring medium.

Figure 4:
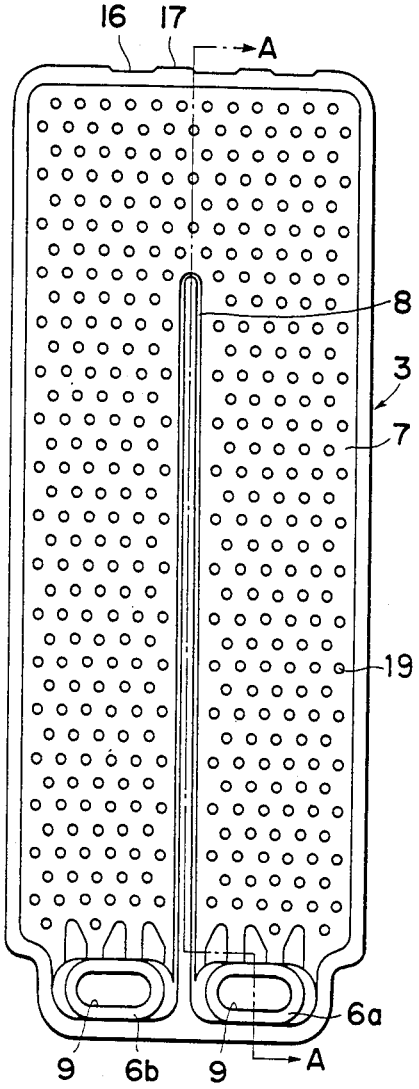
FIG. 4 is a front elevational view of a stamped plate constituting a part of the tube element.
Figure 5:
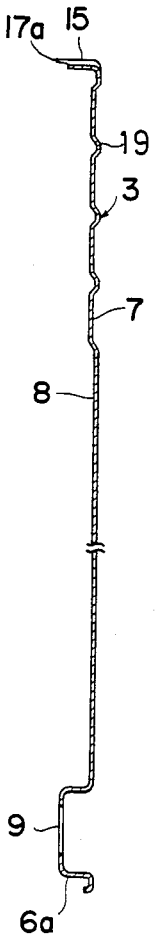
FIG. 5 is a cross-sectional view taken along line A—A of FIG. 3.
Figure 7:
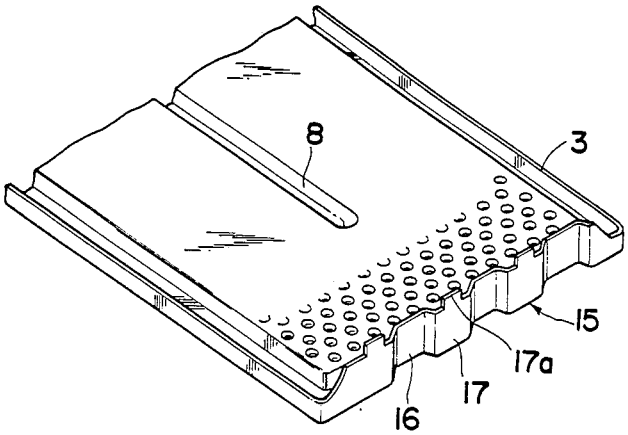
FIG. 7 is a fragmentary perspective view showing a joint portion of the stamped plate.
Figure 8:
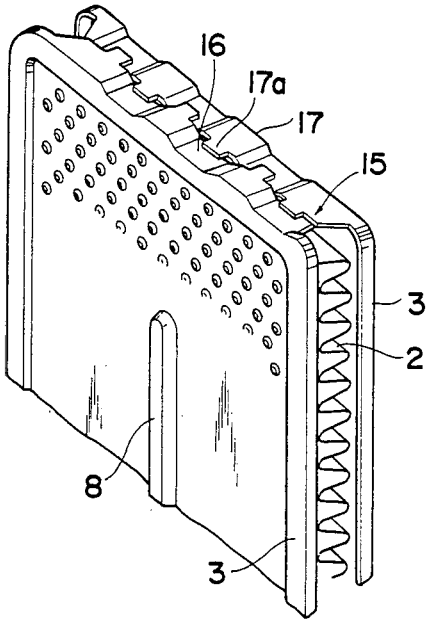
FIG. 8 is a fragmentary perspective view showing a joint area of two assembled stamped plates.

As shown in FIGS. 3 and 4, the stamped plate 3 includes an elongate central ridge 8 projecting inwardly from the web portion 7 and extending upwardly from the confronting peripheral walls of the bulged portions 6a, 6b toward the upper end of the stamped plate 3, the ridge 8 terminating short of the upper end of the stamped plate 3. When two such stamped plates 3 are joined together, the central ridges 8 are brought into abutment with each other, thereby forming a central partition wall 18. With this partition wall 18, the guide channel 5 has a U-shape connected at opposite ends with the tanks 4a, 4b. The outermost two stamped plates 3a, 3b of the heat exchanger are free of bulged portions 6a, 6b and hence they are flat in construction.

The tube element 1 includes a number of projections 19 extending inwardly from the opposed web portions 7 into the guide channel 5. The projections 19 have a frustoconical shape including a flat top end 19a disposed flatwise against the flat top end 19a of the projection 19 on the opposite stamped plate 3. The projections 19 are distributed over the swelled web portion 7 in a zig-zag or staggered arrangement. The size and density of distribution of the projections 19 are set such that the ratio of an area of the web portion 7 including the projections 19 to the remaining area of the web portion 7 free of the projections 19 is 1:4–1:9. This ratio is preferable because the projections 19 provide a large contacting area between the stamped plates 3 and the heat transferring medium while maintaining a large contacting area between the corrugated fin 2 and the projection-free part of the associated stamped plate 3.

The endmost tube elements 1a, 1b of the heat exchanger are connected with end plates 10, 10, respectively, with corrugated fins 2 interposed therebetween. Two hollow cylindrical entrance joints 11a, 11b are disposed respectively between the endmost tube elements 1a, 1a and the end plates 10, 10 and are connected with the tanks 4a of the tube elements 1a, 1b at the upstream side of the heat exchanger. Each of the entrance joints 11a, 11b is composed of a cooperating pair of semi-cylindrical joint members 12a, 12b and includes a flared entrance portion 13 projecting toward the upstream side.

With the heat exchanger thus constructed, the heat transferring medium fed through the entrance joint 11a into the heat exchanger flows into the tanks 4a of a left half of the tube elements 1, then moves upwardly in the respective guide channels 5 along the central ridges 8, thereafter turns downwardly around the upper ends of the central ridges 8, and finally enter the tanks 4b which are disposed at the downstream side of the heat exchanger. Since all of the tanks 4b communicate with each other, the heat transferring medium flows into the tanks 4b of the right half of the tube elements 1. Then the heat transferring medium flows upwardly along the central ridges 8 in the respective guide channels 5, thereafter turns downwardly around the upper ends of the central ridges 8, and flows into the tanks 4a which are disposed at the upstream side of the heat exchanger. The heat transferring medium is thereafter discharged from the tanks 4a through the entrance joint 11b.

The upper ends (tank-free end) of each pair of adjacent tube elements 1, 1 are held in abutment with each other via joint portions or flanges 15, as shown in FIGS.

7 and 8. The joint portion 15 is formed by bending an upper end edge of the stamped plate 3 toward the fin 2 and includes a plurality of alternate parallel grooves 16 and ridges 17 arranged longitudinally of the upper end edge. The grooves and ridges 16, 17 are trapezoidal in cross section and are connected together by slanted intermediate sections. An upstream half and a downstream half of the entire grooves and ridges 16, 17 are disposed asymmetrically with respect to a vertical central line of the stamped plate 3, so that the grooves 16 of one stamped plate 3 are disposed in alignment with the ridges 17 of a mating stamped plate 3 when the two stamped plates 3 are joined together. In this instance, the opposed joint portions 15, 15 engage together at their slanted intermediate sections.

The joint portion 15 further includes a locking bail 17*a* integral with and projecting from each of the ridges 17. The locking bails 17*a* overlie the grooves 16 when the opposite joint portions 15, 15 are joined together.

When the heat exchanger of the foregoing construction is to be assembled, the end plates 10, the entrance joints 11*a*, 11*b*, the stamped plates 3 and the fins 2 are disposed one on another in the manner as shown in FIGS. 1 and 2. At least the stamped plates 3 include a prefabricated cladding of filler metal such as hard-solder. In assembly, one stamped plate 3 of a tube element 1 are combined with one stamped plate of an adjacent tube element 1 with a corrugated fin 2 disposed between the two stamped plates 3 in such a manner that the two tube elements 1, 1 are held in abutment with each other at opposite ends thereof via the opposed tank-forming bulged portions 6*a*, 6*b* and the opposed joint portions 15, 15. A plurality of such combined stamped plates 3 and fins 2 are built up into layers with the help of a suitable jig. The heat exchanger thus preassembled is brazed in a hot oven.

Figure 9:
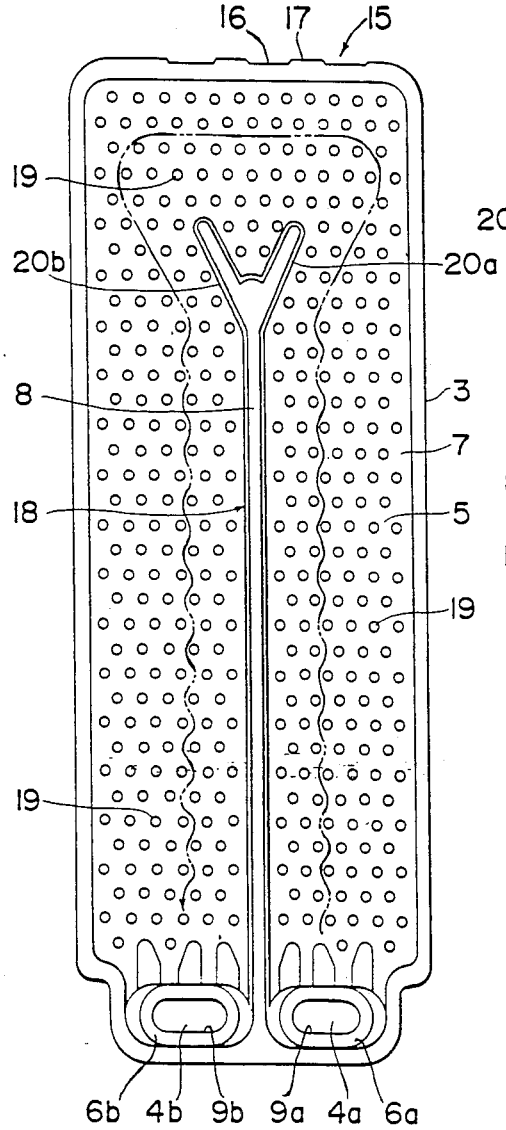
FIG. 9 is a front elevational view of a modified form of stamped plate according to the invention.
Figure 10:
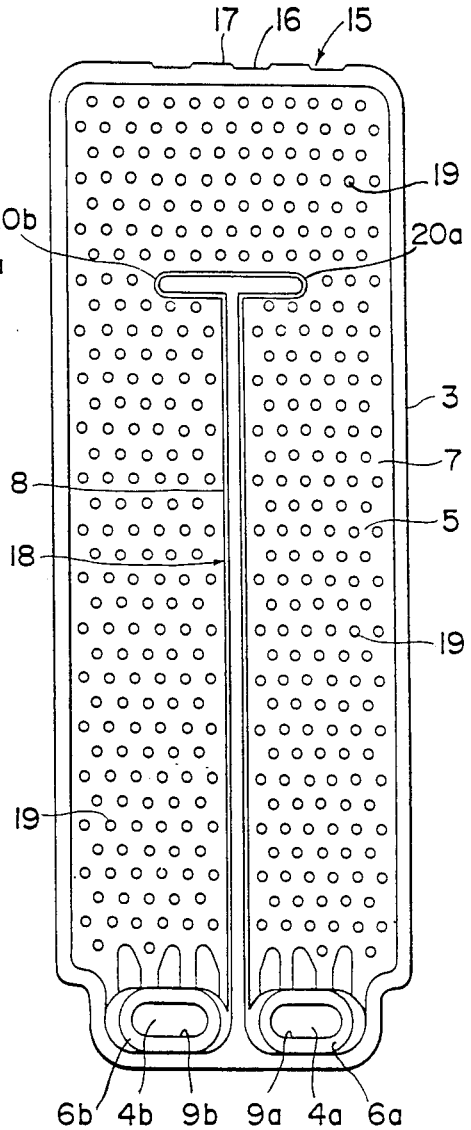
FIG. 10 is a view similar to FIG. 9, but showing a stamped plate according to another embodiment.
Figure 11:
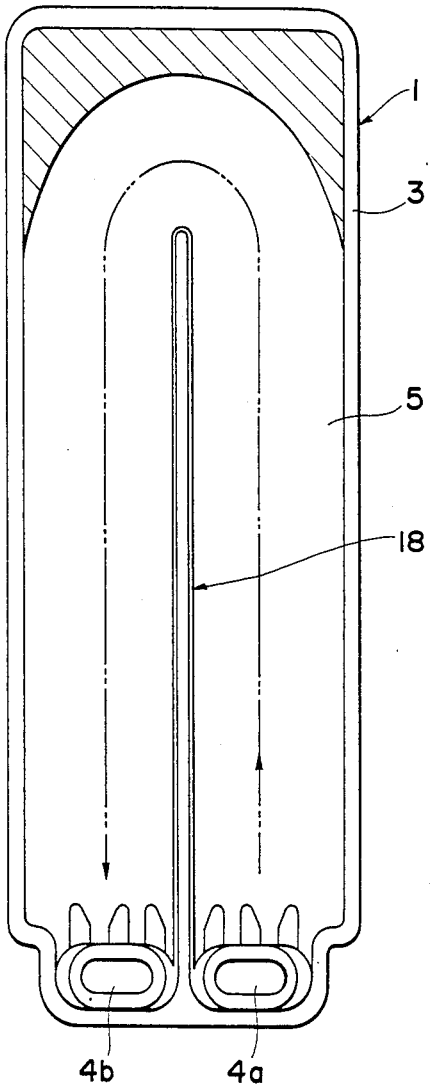
FIG. 11 PRIOR ART
FIG. 11 is a front elevational view of a tube element of a conventional heat exchanger.

A second aspect of the present invention is described below with reference to FIGS. 9 and 10. A modified tube element shown in FIG. 9 is similar to the tube element 1 of the embodiment described above but differs therefrom in that a pair of guide members 20*a*, 20*b* extends upwardly outwardly from an upper end of the partition wall 18 toward the opposite upper corners of the guide channel 5 for directing the heat transferring medium toward the corners. The guide members 20*a*, 20*b* are formed integrally with the partition wall 18 and form jointly with the latter a generally T shape. The guide members 20*a*, 20*b* may be formed separately from the partition wall 18. FIG. 10 shows another modification wherein the guide members 20*a*, 20*b* are disposed in horizontal alignment with each other and form jointly with the partition wall 18 a T shape. In production, the guide members 20*a*, 20*b* are composed of two parts each formed as a V-shaped or an I-shaped end extension of the central ridge 8.

With this arrangement, a heat transferring medium fed from the entrance joint 11*a* into the tanks 4*a* of a left half of the entire tube elements 1 flows upwardly through one side of the U-shaped guide channels 5 in a zig-zag fashion along the partition walls 18, as shown in the arrow indicated by phantom lines in FIG. 9. Upon arrival at the upper end of the partition walls 18, the heat transferring medium is directed by the guide members 20*a*, 20*b* toward the opposite upper corners of the guide channels 5. Thus, the heat transferring medium turns downwardly around the guide members 20*a*, 20*b* while flowing along the opposite corners, then flows downwardly through the opposite side of the guide channel 5 in a zig-zag fashion along the partition wall 18, and enters the tanks 4*b*. After having circulated from the tanks of the right half of the entire tube elements 1 through the guide channels 5 to the tanks 4*a*, the heat transferring medium is discharged from the entrance joint 11*b*. The heat transferring medium as it flows through heat exchanger is distributed uniformly over the entire region of the guide channels 5. With this uniform distribution, a highly efficient heat exchange is obtained between room air and the heat transferring medium with the agency of the swelled web portions 7 of the respective tube elements 1 and the fins 2.

Obviously, various modifications and variations of the present invention are possible in the light of the above teaching. It is therefore to be understood that within the scope of the appended claims the invention may be practiced otherwise than as specifically described.

What is claimed is:

1. A laminated heat exchanger comprising:

(a) a plurality of parallel spaced tube elements, each said tube element being composed of a pair of stamped plates and having two juxtaposed tanks at one end thereof and an internal guide channel extending contiguously from said tanks for the passage therethrough of a heat transferring medium;

(b) a plurality of corrugated fins each disposed between an adjacent pair of said plurality of tube elements;

(c) said tube elements and said fins being laminated into layers; and (d) each said stamped plate including a joint portion extending along an end edge thereof remote from said tanks and having alternate parallel ridges and grooves, said joint portion having intermediate connecting section means for interconnecting adjacent pairs of said grooves and ridges and for abutting an opposed intermediate connecting section means for engaging adjacent tube elements when said joint portion of one tube element abuts the joint portion of an adjacent tube element, and said joint portion having locking means on at least one of said grooves and ridges for holding said joint portion of one tube element in abutment with the joint portion of an adjacent tube element.

2. A laminated heat exchanger according to claim 1, wherein said locking means on said at least one of said groove and said ridge is a locking bail projecting outwardly beyond a plane of abutment between the opposed joint portions.

3. A laminated heat exchanger comprising:

(a) a plurality of parallel spaced tube elements, each said tube element being composed of a pair of stamped plates and having two juxtaposed tanks at one end thereof and an internal guide channel extending contiguously from said tanks for the passage therethrough of a heat transferring medium;

(b) a plurality of corrugated fins each disposed between an adjacent pair of said plurality of tube elements;

(c) said tube elements and said fins being laminated into layers; and (d) each said stamped plate including a joint portion extending along an end edge thereof remote from said tanks and having alternate parallel ridges and grooves, at least one of said grooves and ridges having a locking bail projecting outwardly beyond a plane of abutment between the opposed joint portions, and said joint portion of one tube element being held in abutment with the joint portion of an adjacent tube element.

4. A laminated heat exchanger according to claim 3, said grooves and ridges having a substantially trapezoidal cross-sectional shape.

5. A laminated heat exchanger according to claim 3, each said tube element including a plurality of projections disposed in said guide channel.

6. A laminated heat exchanger according to claim 5, said projections having a frustconical shape.

7. A laminated heat exchanger according to claim 5, said projections being disposed in a zig-zag arrangement.

8. A laminated heat exchanger according to claim 5, the ratio of an area of each said tube element including said projections to the remaining area of said tube element free of said projection being 1:4–1.9.

* * * * *